US008621713B2

(12) United States Patent
Zimmer et al.

(10) Patent No.: US 8,621,713 B2
(45) Date of Patent: Jan. 7, 2014

(54) ARRANGEMENT FOR DAMPING AND/OR RETARDING

(76) Inventors: Günther Zimmer, Rheinau (DE); Martin Zimmer, Rheinau (DE)

( * ) Notice: Subject to any disclaimer, the term of this patent is extended or adjusted under 35 U.S.C. 154(b) by 0 days.

(21) Appl. No.: 13/407,862

(22) Filed: Feb. 29, 2012

(65) Prior Publication Data

US 2012/0180262 A1 Jul. 19, 2012

Related U.S. Application Data

(63) Continuation-in-part of application No. PCT/DE2010/001012, filed on Aug. 30, 2010.

(30) Foreign Application Priority Data

Sep. 1, 2009 (DE) ..... 10 2009 039 559

(51) Int. Cl.
*E05F 1/08* (2006.01)

(52) U.S. Cl.
USPC ..... 16/286; 16/82; 16/85

(58) Field of Classification Search
USPC ..... 16/286, 287, 288, 54, 56, 366, 370, 16/371, 354, 82
See application file for complete search history.

(56) References Cited

U.S. PATENT DOCUMENTS

| | | | | |
|---|---|---|---|---|
| 6,846,053 | B2 * | 1/2005 | Salice | 312/334.14 |
| 7,562,416 | B2 * | 7/2009 | Lautenschlager et al. | 16/286 |
| 2005/0204651 | A1 | 9/2005 | Li | |
| 2007/0157429 | A1 * | 7/2007 | Gallasch et al. | 16/238 |
| 2008/0168620 | A1 * | 7/2008 | Hammerle | 16/85 |
| 2013/0055528 | A1 * | 3/2013 | Lowe | 16/85 |

FOREIGN PATENT DOCUMENTS

| | | | |
|---|---|---|---|
| CN | 201087643 | Y * | 7/2008 |
| DE | 20 2004 011 636 | | 10/2004 |
| DE | 20 2005 011 752 | | 1/2007 |
| WO | WO 2005/088052 | | 9/2005 |
| WO | WO 2006/088435 | | 8/2006 |
| WO | WO 2007/009899 | | 1/2007 |
| WO | WO 2008/020682 | | 2/2008 |

* cited by examiner

*Primary Examiner* — Chuck Mah
(74) *Attorney, Agent, or Firm* — Klaus J. Bach

(57) ABSTRACT

In an arrangement for damping and/or retarding a movable part, including a housing with a pressure member slidably supported in the housing and a cylinder piston unit arranged in the pressure member and in the housing wherein the housing includes a mounting flange with a support surface provided with at least two throughbores, the mounting flange has at least two spaced guide surfaces which are oriented at least approximately normal to the support surface, the guide surfaces delimiting an adapter area at several sides thereof. The damping arrangement can be used and installed rapidly and accurately to various types of hinges.

8 Claims, 4 Drawing Sheets

ARRANGEMENT FOR DAMPING AND/OR RETARDING

This is a continuation-in-part application of international patent application PCT/DE2010/001012 filed Aug. 30, 2010 and claiming the priority of German patent application 10 2009 039 559.8 filed Sep. 1, 2009.

The invention resides in an arrangement for damping and/or retarding a movable part, including a housing with a pressure member slidably supported in the housing and a cylinder piston unit arranged in the housing and in the pressure member and including a mounting flange with a support plane and at least two cut-outs.

WO 2005/088052A1 discloses a damping arrangement which may be disposed on a hinge pot. By means of two screws, the hinge pot and the damping arrangement are mounted together to the door of a furniture piece. For a retrofit installation of the damping arrangement either the mounting screws of the hinge pot have to be unscrewed or additional bores have to be drilled into the hinge pot flange.

It is the object of the present invention to provide a damping arrangement which can be installed rapidly and accurately in connection with, and retro-fitted to, various hinge designs.

SUMMARY OF THE INVENTION

In an arrangement for damping and/or retarding a movable part, including a housing with a pressure member slidably supported in the housing and a cylinder piston unit arranged in the pressure member and in the housing wherein the housing includes a mounting flange with a support surface provided with at least two throughbores, the mounting flange has at least two spaced guide surfaces which are oriented at least approximately normal to the support surface, the guide surfaces delimiting an adapter area at several sides thereof. The damping arrangement can be used and installed rapidly and accurately to various types of hinges.

Further features of the invention will become more readily apparent from the following description of schematically shown embodiments.

DESCRIPTION OF PARTICULAR EMBODIMENTS

Figure 1:
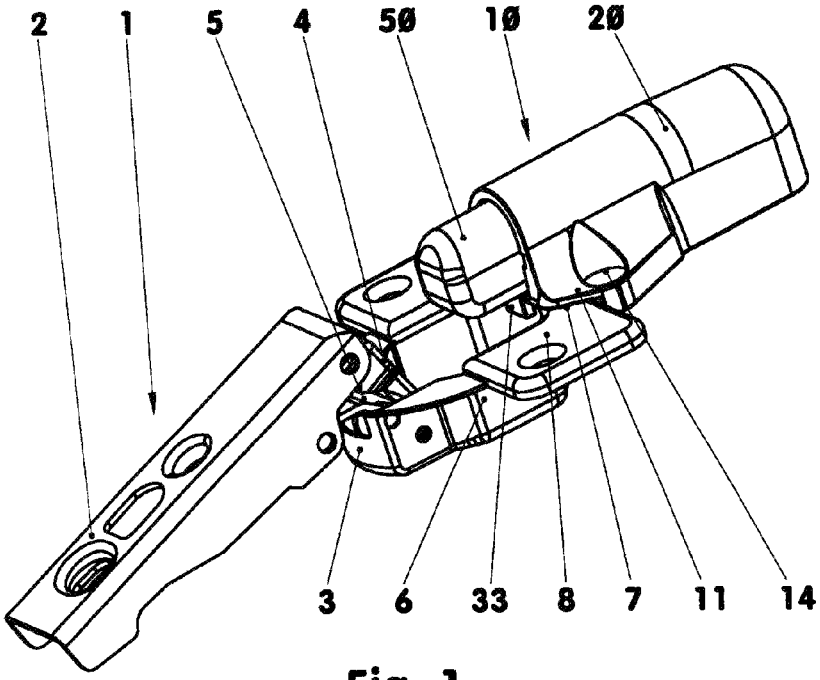
FIG. 1 shows a hinge with a damping arrangement.
Figure 2:
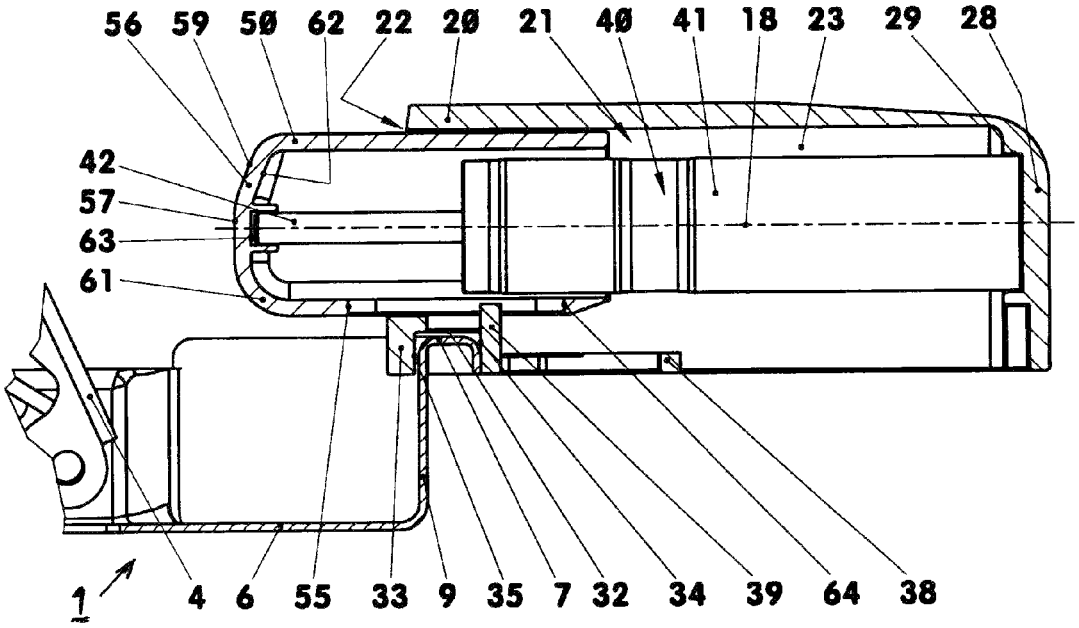
FIG. 2 is a partial longitudinal sectional view of FIG. 1.

FIG. 1 shows, in a perspective view, a hinge 1 with an arrangement 10 for damping and/or retarding a movable part and FIG. 2 shows a partial longitudinal cross-section of such a hinge 1 in connection with such a damping arrangement 10.

The hinge 1 shown in FIGS. 1 and 2 is a pot hinge. It has two hinge legs 2, 3 of which one (2) is attached for example to a furniture body and the other (3) to a pivotable door of a furniture body. The two hinge legs 2, 3 are pivotally interconnected by means of two hinge levers 4, 5. The pivot angle of the hinge 1 is limited by the open and closed end positions of the hinge 1 and is for example 110 degrees. The hinge leg 2 to be attached to the furniture body is in the representation of FIG. 1 a mounting leg 2. The hinge leg 3 to be attached to the door includes a hinge pot 6 with a flange 8.

Figure 3:
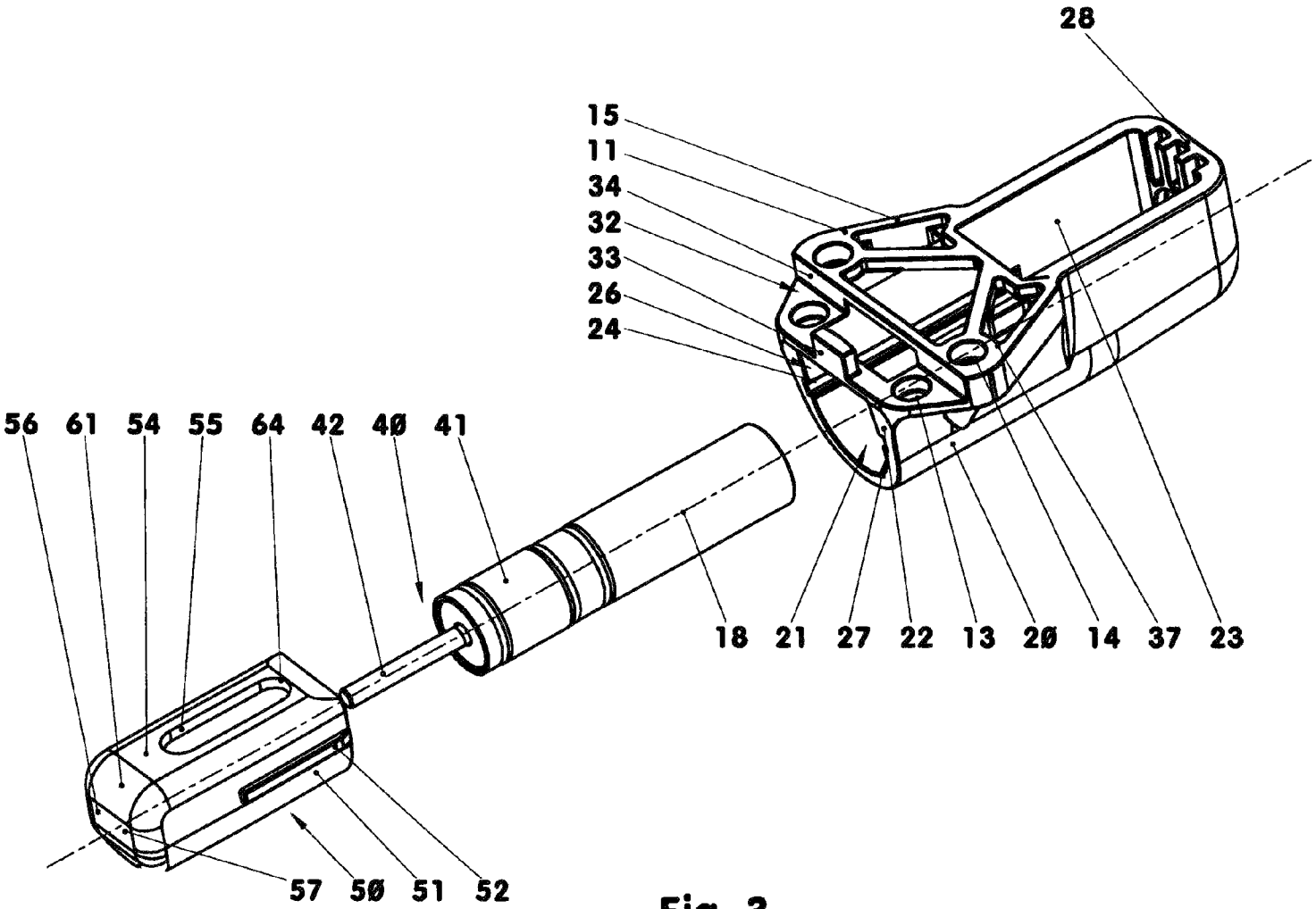
FIG. 3 is an exploded representation of a damping arrangement.

The damping arrangement 10 is shown in FIG. 3 in an exploded view. It comprises a housing 20, a cylinder-piston unit 40 and a pressure member 50. It is centered on the hinge pot 6 by means of an adapter 32 including a guide lug 33 and two guide surfaces 34, 35 and can be mounted to the pivotable door panel of the furniture body for example outside of the hinge pot 6 by means of a mounting flange 11. The damping arrangement 10 however may also be attached to the hinge 1.

In the exemplary embodiment, the damping arrangement 10 has a maximum overall length of 50 millimeters and a width of 45 millimeters in the area of the mounting flange 11. The stroke of the pressure member 50 relative to the housing 20 is for example 12 millimeter.

Figure 4:
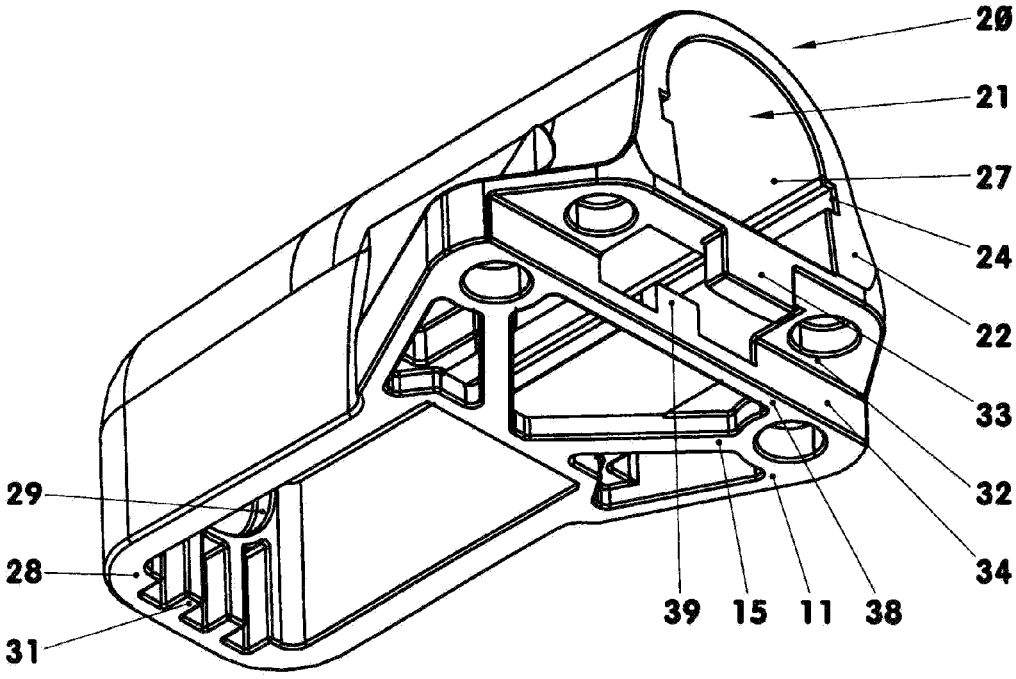
FIG. 4 shows a housing.
Figure 5:
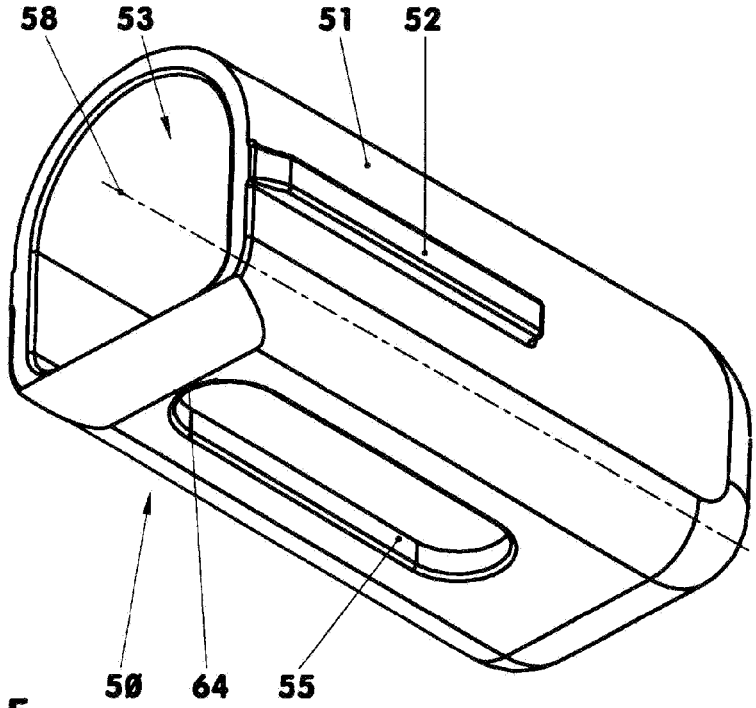
FIG. 5 shows a pressure member.

The housing 20 shown in FIG. 4 as an individual component is an injection molded part consisting for example of a thermoplastic material. It may also consist of aluminum or an aluminum alloy. It has a semi-oval interior space 21 which is open toward the bottom and toward the front end 22. The wall 23 of the interior space 21 includes two oppositely arranged guide grooves 24, which extend to the front end 22. Their length is about 25 millimeter and their height is about 1.3 millimeter. The guide grooves 24 are for example 1 millimeter deep. The distance between the opposite areas 26, 27 of the inner wall 23 is in the exemplary embodiment 12 millimeters.

The closed rear end wall 28 of the housing 20 is provided with an accommodation recess 29 oriented toward the interior space 21 as well as with reinforcement ribs 31.

The housing 20 has a bottom plate 38, which is provided with openings and which comprises an adapter area 32 including a guide lug 33 which is formed integrally with the housing 20 and projects therefrom. The adapter area 32 which here is in the form of an accommodation recess extends normal to the vertical longitudinal center plane of the arrangement 10. The vertical center plane is also normal to the support plane 15 and includes the center axis 18. In the direction of the center axis 18, the adapter area 32 is longer, for example by 6%, than the edge 7 of the hinge pot 6, see FIG. 2. In the assembled state, the adapter area 32 extends around the edge 7 at least in some areas. The inner surface of the adapter area 32 which faces the guide lug 33 and extends normal to the support plane 15 is a guide surface 34.

The centering lug 33 delimits the adapter area 32 and is aligned for example with the support plane 15 of the damper arrangement. In the exemplary embodiment, it has an at least approximately parallelepiped shape with a guide surface 35 which is oriented normal to the vertical longitudinal center plane of the arrangement 10 and normal to the support plane. But it may also have a cylindrical shape with a circular, oval or elliptical cross-section. With such an embodiment, the guide surface 35 of the adapter are 32 faces the outer surface of the guide lug 33. At least the guide surface area 35 of the guide leg 33 facing the rear end wall 3 of the hinge pot 6 may also be inclined so that the head cross-section of the guide lug 33 is smaller than the first end cross-section at the bottom plate 38. The two guide surfaces 34, 35 are oriented at least approximately opposite each other. This means that their normal surface vectors point in opposite directions wherein however the individual normal vector may deviate from this direction by an angle of up to 30 degrees.

The length of the bottom plate 38 in the direction of the center axis 18 corresponds in the exemplary embodiment to half the length of the housing 20. The bottom plate 38 comprises additionally the mounting flange 11 which has in the representation of FIGS. 3 and 4 four through-bores 13, 14. Two throughbores 13 are disposed on the extension of the adapter area 32, the other two throughbores 14 are disposed outside the adapter area 32 displaced for example in the longitudinal direction of the damping arrangement 10. The throughbores 13 serve for example the reduction of the use of material. The damping arrangement 10 however may also be attached to the hinge 1 or to the door panel outside the hinge 1 for example by means of screws which extend through the throughbores 13. The damping arrangement 10 may be mounted to the furniture piece by screws extending through the throughbores 14.

The pressure member 50 is a pot-shaped component which is open at one side thereof. It is shown in FIG. 3 as an individual part. The pressure member 50 has for example in the direction of the longitudinal axis 58 a length of 95% of the length of the guide groove 24. Its wall thickness is for example 1 millimeter. The outer surface 51 of the pressure member 50 includes two guide tracks 52 which are oriented in the longitudinal direction and which extend to a point in the proximity of the opening 53. The height of these guide tracks 52 is for example 0.7 millimeter and their length is half the length of the pressure member 50. By means of these guide tracks 52, the pressure member 50 is supported in the guide grooves 24 of the housing 20. Because of this large guide length, a cogging of the pressure member 50 in the housing 20 is prevented. The vertical and the lateral plays of the pressure member 50 in the housing 20 are for example in each case 0.5 millimeter. This allows a maximally inclined position of the pressure member 50 with respect to the center axis 18 of the damping arrangement 10 of 2.4 degrees.

At the bottom side 54 of the pressure member 10 an elongated opening 55 as arranged. Its length as shown in the exemplary embodiment is for example four thirds of the maximum stroke of the pressure member 50. The elongated opening is for example four millimeter wide. In the assembled state, the elongated opening 55 forms for example with a stop pin 39 arranged in the housing a stroke limit.

The end wall 56 opposite the opening 53 is provided in the exemplary embodiment with a central section 57 which extends normal to the longitudinal axis 58 of the pressure member 50. Above this central section 57, a section 59 is provided which is inclined with respect to the central section 57 by for example 22 degrees, see FIG. 2. In the lower area, the end wall 56 has a curved section 61. The end wall may also be curved convexly about one or two axes; it may include an inclined plane etc. At its inside 62, the front end wall 56 includes an accommodation recess 63.

The accommodation recess 29 of the housing 20 and the accommodation recess 63 of the pressure member 50 support the cylinder piston unit 40. The cylinder-piston unit 40 comprises a cylinder 41 and a piston which is connected to a piston rod extending from the cylinder 41. In the cylinder 41, which is for example filled with an oil, the spring-biased piston, which includes for example throttle valves, separates a displacement chamber from a compensation chamber. The cylinder 41 is disposed in the accommodation recess 29 with radial play. The piston rod 42 is accommodated in the accommodation recess 63 also with radial play. The radial play of the cylinder-piston unit 40 with respect to the housing 20 and the pressure member 50 is for example greater than the play of the pressure member 50 relative to the housing 20. The cylinder-piston unit 40 may also be installed reversed in the damper arrangement 10.

For the assembly of the damper arrangement 10, first the cylinder piston unit 40 is inserted into the housing 20. Then the pressure member 50 is installed and engaged by the lug. The installation may also be performed in another sequence.

The damper arrangement 10 consequently consists only of three parts, that is, the housing 20, the cylinder-piston unit 40 and the pressure member 50. It is inexpensive to manufacture and can be installed without special tools.

It is also possible to form the pressure member 50 and the cylinder 41 of the cylinder-piston unit 40 as a single component. Then the elongated opening 55 is a cavity in the cylinder housing oriented in the longitudinal direction of the cylinder. The piston rod 42 is supported in the embodiment in the housing 20. Such a damper arrangement comprises only two parts.

The assembled damper arrangement 10 may be placed with its support plane 15 for example onto the door panel. Herein the damper arrangement 10 is aligned by means of the guide surface 34 of the adapter area 32 with the edge 7 of the hinge pot 6. In addition, the guide lug 33 extends into the hinge pot 6. The guide surface 35 of the guide lug 33 may abut the rear end wall 9 of the hinge pot 6 or it may be spaced therefrom for example by up to one millimeter. The guide leg 33 forms in this way a centering member by which the position of the damper arrangement 10 relative to the hinge is determined. Lateral movement or pivoting of the damping arrangement 10 relative to the hinge 1 is prevented except within the position tolerance. The adapter area 32 surrounds, with its guide surfaces 34, 35 disposed at different sides, the edge 7 of the hinge pot 6. The damping arrangement 10 is mounted to the door panel for example by means of screws which extend through the throughbores 14.

Upon closing the furniture door, the two hinge legs 2, 3 pivot relative to each other. The pressure member 50 approaches the mounting leg 2. As soon as the pressure member 50 contacts the mounting leg 2 or the outer hinge lever 4, it is moved inwardly. In the process, it slides along the hinge leg 2 or the outer hinge lever 4. The pressure member 50 moves, in the pivot angle next to the closed end position of the hinge 1, the piston rod 42 together with the piston inwardly. In this procedure, the elongated opening 55 moves along relative to the stop pin 39. With a possible off-center force application, the guide structure 24, 52 takes up the transverse force components so that the cylinder piston unit 40 is subjected to a force only in the direction parallel to the piston rod 42. The piston rod seal is therefore not subjected to transverse forces which could cause leakages of the cylinder piston unit 40. Upon inward movement of the piston, for example a hydraulic or pneumatic medium is displaced in a throttled manner and the speed of the door panel is reduced. This retardation is for example greater the greater the angular pivot speed of the door panel is. The force transmitted to the cylinder piston unit 40 is transferred to the housing 20 and from there, via the mounting flange 11, to the furniture door.

Upon opening the door, the pressure member 50 is moved away from the hinge leg 2 or from the outer hinge lever 4. For example, the spring arranged in the cylinder 41 pushes the piston with the piston rod 42 and the pressure member 50 outwardly. The elongated opening 55 moves thereby along the stop pin 39 until its rear edge 64 abuts the stop pin 39. The stop pin 39 now prevents further outward movement of the pressure member 50. It forms therefore an end stop for the extended position of the damper arrangement 10.

The damping arrangement (10) can be arranged on all pot hinges 1 whose rim or edge 7 in the direction of the center axis 18 is shorter than the length of the adapter area 32 in this direction.

Figure 6:
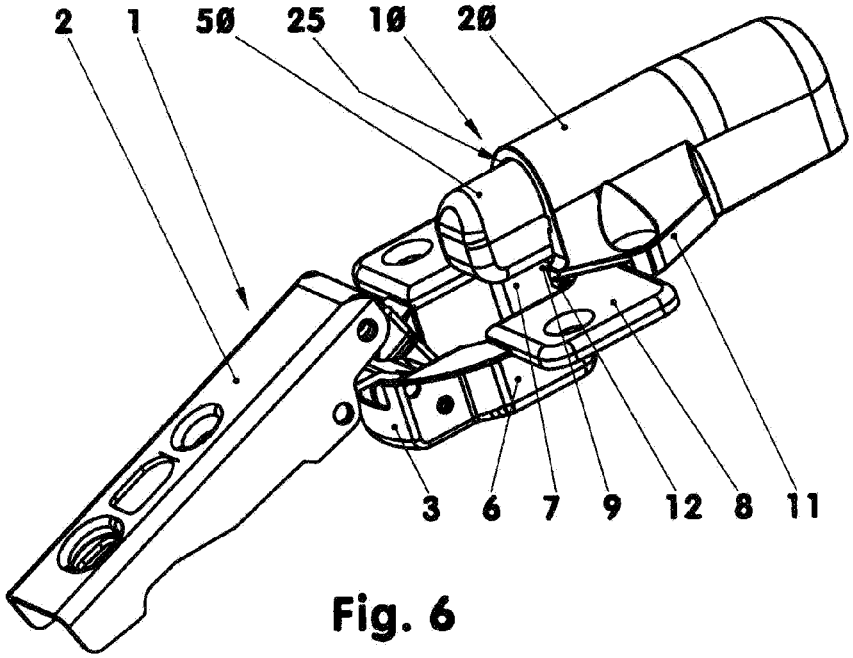
FIG. 6 shows a hinge with two centering pins.

FIG. 6 shows another embodiment of the hinge 1 including a damping arrangement 10. The hinge pot 6 has for example a rear end wall 9 provided with a recess. The damping arrangement 10 has two guide pins 12, 36, which are arranged at the side of the front end opening 25 of the housing 20. They project for example in the direction of the end wall 56 of the pressure member 50 by three millimeters. The length of the guide pins 12, 36 normal to the support plane 15 corresponds to the length of the guide lug 33 shown in the first exemplary embodiment.

Figure 7:
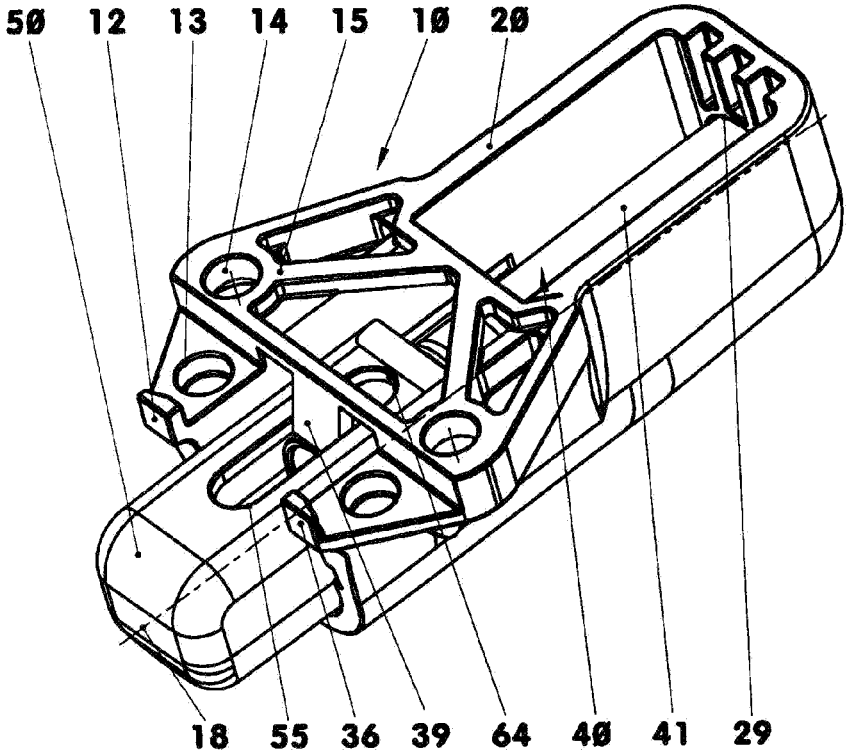
FIG. 7 is a bottom view of a damping arrangement with two centering pins.

FIG. 7 is a perspective bottom view of a damping arrangement 10 including an adapter area 32 with two non-centered guide pins 12, 36. The cylinder piston unit 40 is disposed in the housing 20. Herein the cylinder 41 is accommodated in the accommodation recess 29 with radial play. The piston rod 42 is supported in the pressure member 50 as shown in FIG. 2.

The pressure member 50 is supported in guide grooves 24 of the housing 20 so as to be slideable in the direction of the center axis 18. At its bottom side 54, the pressure member 50 has an elongated opening 55 into which a stop pin 39, which is integrally formed with the housing 20, projects. The mounting flange 11 of the damping arrangement 10 has four throughbores 13, 14 of which in each case two (13) are accommodated in the adapter area 32 and the two others (14) are arranged outside the adapter area 32.

The assembly and installation of the damping arrangement 10 is performed as described earlier. After installation, the damping arrangement 10 is disposed on the side of the door panel, for example on the pot hinge 1.

The adapter area 32 and the guide lug 33 engage therebetween the edge 7 of the hinge pot 6 adjacent the rear end wall 9 thereof. In this way, the damping arrangement 10 can be mounted without the need for any fitting work. As a result, the damping arrangement 10 can be added to a hinge 1 without adaptation work. In the exemplary embodiment, the two guide pins 12, 36 are disposed, after installation, in an area outside the hinge pot 6. This damping arrangement 10 can therefore be used in connection with pot hinges 1 whose hinge leg 2 mounted on the furniture body extends with the hinge 1 pivoted to a closest state over the length of the hinge pot 6 in the direction of the center axis 18 by more than 90%. Of course, the damper arrangement 10 may also be used in connection with other types of pot hinges 1.

The adapter area 32 may extend around the edge 7 of the hinge pot 6. To this end, it may have for example three guide surface areas of which one is for example arranged like the guide surface 34 shown in the first embodiment. The two other guide surface areas are then arranged opposite each other at the edge areas oriented in the longitudinal direction of the hinge 1.

Instead of the arrangement 10 as described, it is also possible to install a retardation arrangement wherein for example air is discharged from the cylinder compression chamber to the ambient upon actuation of the arrangement. The return movement of the retardation arrangement occurs for example by means of a spring.

The arrangement for damping and/or retarding 10 may also be arranged at an open end position of two parts which are movable relative to each other such as a slide or pivot door.

Also, a combination of the various exemplary embodiments is possible.

Listing of Reference Numerals:

| | |
|---|---|
| 1 | Hinge |
| 2 | Hinge leg |

-continued

Listing of Reference Numerals:

| | |
|---|---|
| 3 | Hinge leg |
| 4 | Hinge lever |
| 5 | Hinge lever |
| 6 | Hinge pot |
| 7 | Edge of hinge pot |
| 8 | Flange |
| 9 | Rear end wall |
| 10 | Arrangement for damping and retarding |
| 11 | Mounting flange |
| 12 | Guide pin |
| 13 | Throughbore |
| 14 | Throughbore |
| 15 | Support plane |
| 18 | Center axis |
| 20 | Housing |
| 21 | Interior space |
| 22 | Front end |
| 23 | Inner wall |
| 24 | Guide groove |
| 25 | Opening |
| 26 | Area of inner wall |
| 27 | Area of inner wall |
| 28 | Rear end wall |
| 29 | Accommodation recess |
| 31 | Reinforcement ribs |
| 32 | Adapter area |
| 33 | Guide lug |
| 34 | Guide surface |
| 35 | Guide surface |
| 36 | Guide pin |
| 38 | Bottom plate |
| 39 | Stop pin |
| 40 | Cylinder-piston unit |
| 41 | Cylinder |
| 42 | Piston rod |
| 50 | Pressure member |
| 51 | Outer surface |
| 52 | Guide tracks |
| 53 | Opening |
| 54 | Bottom side |
| 55 | Elongated opening |
| 56 | End wall |
| 57 | Central section |
| 58 | Longitudinal axis |
| 59 | Inclined section |
| 61 | Curved section |
| 62 | Inner wall |
| 63 | Accommodation recess |
| 64 | Rear edge of elongated opening |

What is claimed is:

1. An arrangement (10) for damping and retarding a movable part, said arrangement including:

a housing (20) with a pressure member (50) slidably supported in the housing (20) and a cylinder-piston unit (40) operatively arranged between the housing (20) and the pressure member (50), the housing (20) including a mounting flange (11) with a planar support area (15) provided with at least two throughbores (13, 14) for mounting the housing (20);

the mounting flange (11) including at least two spaced guide surfaces (34, 35) oriented at least approximately normal to the support area (15);

the at least two spaced guide surfaces (34, 35) being established by:

a guiding-centering lug (33) or two spaced guide pins (12, 36) extending from the housing and defining one of the guide surfaces and a stop pin (39) extending from the support area (15) and defining the other one of the guide surfaces;

said at least two spaced guide surfaces forming a recessed adapter area (32) with several sides for accommodating a mounting rim (7) of a hinge pot (6), and the at least two throughbores (13, 14) of the mounting flange (11) being disposed outside the adapter area (32) and extending through the support area (15).

2. The arrangement (10) according to claim 1, wherein the guide surfaces (34, 35) are inner surfaces of the adapter area (32).

3. The arrangement (10) according to claim 1, wherein the adapter area (32) includes two spaced guide pins (12, 36).

4. The arrangement (10) according to claim 1, wherein the pressure member (50) is formed integrally with the cylinder (41) of the cylinder-piston unit (40).

5. A hinge (1) with a hinge pot (6) and an arrangement (10) for damping and retarding a movable part, including:

a housing (20) with a pressure member (50) slidably supported in the housing (20) and a cylinder-piston unit operatively arranged between the housing (20) and the pressure member (50), the housing (20) including a mounting flange (11) with a planar support area (15) provided with at least two throughbores (13, 14) for mounting the housing (20);

the mounting flange (11) including at least two spaced guide surfaces (34, 35) oriented at least approximately normal to the support area (15), at least one of the guide surfaces being formed by two spaced guide pins (12, 36) extending from the housing, and said at least two spaced guide surfaces forming a recessed adapter area (32) with several side surfaces for receiving and engaging a mounting rim (7) of the hinge pot (6) with the guide pins (12, 36) extending into the hinge pot (6).

6. The hinge according to claim 5, wherein the adapter area (32) extends around the rim (7) of the hinge pot (6).

7. A furniture piece with a hinge (1) having a hinge pot (6) and an arrangement (10) for damping and retarding a movable part, including:

a housing (20) with a pressure member (50) slidably supported in the housing (20) and a cylinder-piston unit operatively arranged between the housing (20) and the pressure member (50), the housing (20) including a mounting flange (11) with a planar support area (15) provided with at least two throughbores (13, 14) for mounting the housing (20);

the mounting flange (11) including at least two spaced guide surfaces (34, 35) oriented at least approximately normal to the support area (15), and said at least two spaced guide surfaces forming a recessed adapter area (32) with several sides thereof for accommodating a mounting rim (7) of said hinge pot, at least one of the guide surfaces (34, 35) being formed by guide pins (12, 36) extending from the housing into the hinge pot (6), and the hinge (1) interconnecting a door panel and a furniture body for relative pivotal movement relative to the furniture body.

8. The furniture piece according to claim 7, wherein the arrangement for damping and retarding (10) is mounted to the door panel by mounting means which extend through the throughbores (13, 14).

* * * * *